US005319430A

United States Patent [19]

DeBolt et al.

[11] Patent Number: 5,319,430

[45] Date of Patent: Jun. 7, 1994

[54] FUSER MECHANISM HAVING CROWNED ROLLS

[75] Inventors: Frederick C. DeBolt; Kenneth R. Rasch, both of Fairport; Russell A. Parisi, Williamson, all of N.Y.

[73] Assignee: Xerox Corporation, Stamford, Conn.

[21] Appl. No.: 343

[22] Filed: Jan. 4, 1993

[51] Int. Cl.[5] ..... G03G 15/20

[52] U.S. Cl. ..... 355/290; 100/155 R; 100/176; 219/216; 355/285; 355/289; 355/295; 492/27; 492/28; 492/46

[58] Field of Search ..... 355/282, 285, 289-290, 355/295; 219/216; 492/28, 27, 30, 46; 430/99, 124; 100/155 R, 162 B, 176

[56] References Cited

U.S. PATENT DOCUMENTS

| | | | |
|---|---|---|---|
| 1,875,257 | 8/1932 | Nylund | 492/27 X |
| 2,191,144 | 2/1940 | Hornbostel | 492/27 X |
| 2,732,591 | 1/1956 | Whitton | 492/27 X |
| 3,437,032 | 4/1969 | Manghirmalani et al. | 100/155 R X |
| 3,884,623 | 5/1975 | Slack | 492/27 X |
| 3,941,558 | 3/1976 | Takiguchi | 432/60 |
| 4,393,804 | 7/1983 | Nygard et al. | 118/60 |
| 4,557,588 | 12/1985 | Tomosada | 355/14 |
| 4,594,068 | 6/1986 | Bardotzky et al. | 219/216 X |
| 4,812,873 | 3/1989 | Inagaki et al. | 219/216 X |
| 4,939,552 | 7/1990 | Nakanishi | 355/300 |
| 4,955,221 | 9/1990 | Feldmann et al. | 492/27 X |
| 5,045,890 | 9/1991 | DeBolt et al. | 355/284 |
| 5,049,944 | 9/1991 | DeBolt et al. | 355/284 |
| 5,153,660 | 10/1992 | Goto | 355/285 |

FOREIGN PATENT DOCUMENTS

| | | | |
|---|---|---|---|
| 0043869 | 1/1982 | European Pat. Off. | 492/27 |
| 184173A | 4/1982 | Japan . | |
| 251881A | 5/1985 | Japan . | |
| 0227905 | 11/1985 | Japan | 492/27 |
| 0802179 | 10/1958 | United Kingdom | 492/27 |

*Primary Examiner*—Matthew S. Smith

[57] ABSTRACT

A roll fuser assembly including a fuser roll and a pressure roll. The rolls are crowned and are supported in pressure engagement with each other to form a fusing nip. The pressure engagement of the rolls eliminate nonuniform nip loading in wide fusers as well as providing uniform velocity through the fuser roll/pressure roll nip. It is preferred that the crowned profile of one of the rolls be substantially to the center of the roll and that the other be offset therefrom. It is further preferred that the diameters of each of the rolls be substantially the same at each end.

3 Claims, 3 Drawing Sheets

FUSER MECHANISM HAVING CROWNED ROLLS

The present invention relates to fuser apparatus for electrostatographic printing machines and in particular to oversized (i.e. wide rolls) roll fusers.

The following patents and patent applications are hereby incorporated herein by reference thereto:

U.S. patent application Ser. No. 08/000151 filed on the same date as the present application, entitled IMPROVED WEB RELEASE AGENT SYSTEM FOR A HEAT AND PRESSURE FUSER, and assigned to Xerox Corporation;

U.S. Pat. No. 5,045,890, Issued Sep. 3, 1991 to DeBolt et al., and assigned to Xerox Corporation; and U.S. Pat. No. 5,049,944, Issued Sep. 17, 1991 to DeBolt et al., and assigned to Xerox Corporation.

BACKGROUND OF THE INVENTION

In imaging systems commonly used today, a charge retentive surface is typically charged to a uniform potential and thereafter exposed to a light source to thereby selectively discharge the charge retentive surface to form a latent electrostatic image thereon. The image may comprise either the discharged portions or the charged portions of the charge retentive surface. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface, such as plain paper to which it may be permanently affixed by heating or by the application of pressure or a combination of both.

In order to fix or fuse the toner material onto a support member or substrate, such as a sheet, permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with a material, such as a silicone rubber or other low surface energy elastomer or, for example, tetrafluoroethylene resin sold by E. I. DuPont De Nemours under the trademark Teflon. In these fusing systems, however, since the toner image is tackified by heat it frequently happens that a part of the image carried on the supporting substrate will be retrained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate. In order to prevent this from happening, a release agent application mechanism is generally utilized.

Wide, small diameter roll fusers also inherently suffer from excessive fuser and pressure roll deflection. The load on the fuser rolls required is a function of speed and type of image to be fused. Bending of a beam, or roller, is inversely proportional to the cube of the length thus, as fuser get wider the rolls bend appreciably more at a given load. Likewise, the bending of a beam with a round cross section, or roller, is directly proportional to the cube of the roll radius. So if it is desired to make the roll a little smaller the deflection increases significantly. The goal in a fuser nip is to produce nearly uniform load across the width. As the roll deflects the load at the ends increase thereby producing paper handing problems, if the load is too nonuniform (e.g. wrinkling or creasing of the sheet).

It is known that skewing the fuser roll with respect to the pressure roll and wrapping one roll around the other tend to counteract the uneven load distribution caused by roll bending. However, the bent shape roll is a curve which is a cubic function, and it is being wrapped around a circular roll with is a squared function. Thus, resulting load distribution is a maximum about one quarter of the roll length in from each end to get a "bow tie" nip. Skewing has been successfully employed for fairly stiff systems and very flexible systems. The former needs very little compensation and thus little "bow tie" effect is apparent while the latter requires a lot of skew but the stiffness is low enough that the "bow tie" effect is not visible. Skewing also generates lateral thrust forces that wear the roll surface.

It is also known to profile fuser rollers so that the shapes of the fuser tends to overcome the bending problem or even to place a third roll in pressure engagement with the fuser opposite the pressure roll to overcome the deflection in the ends of the fuser roll. Uneven roll load distribution can also be prevented by crowning one of the two fuser rolls. However, crowning of one of two fuser rolls results in nip velocity problems which induce paper wrinkle.

The following references may be of relevance to the present invention:

- U.S. Pat. No. 3,941,558; Patentee: Takiguchi; Issued: Mar. 2, 1976.
- U.S. Pat. No. 4,393,804; Patentee: Nygard et al; Issued: Jul. 19, 1983.
- U.S. Pat. No. 4,557,588; Patentee: Tomosada; Issued: Dec. 10, 1985.
- U.S. Pat. No. 4,939,552; Patentee: Nakanishi; Issued: Jul. 3, 1990.
- U.S. Pat. No. 5,045,890; Patentee: DeBolt et al.; Issued: Sep. 3, 1991.
- U.S. Pat. No. 5,049,944; Patentee: DeBolt et al.; Issued: Sep. 17, 1991.
- JPPN-58-184173 (A); Patentee: Katou; Published: Oct. 27, 1983.

JPPN-61-251881 (A) Patentee: Takizawa; Published: Nov. 8, 1986.

The foregoing references may be summarized as follows:

U.S. Pat. No. 3,941,558 discloses a rolled web impregnated with silicone oil for preventing offset. The web has a thickness of 2 mm, a total length of 50 cm, and travels 1 cm per thousand copies between the supply and take-up rollers. This system transfers about 0.003 cc of oil to the fuser per copy.

U.S. Pat. No. 4,393,804 discloses a rolled web system that moves between a supply core and take-up roller. A felt applicator supplies oil from a supply reservoir to the web. The take-up core is driven by a slip clutch at a speed greater than the speed of the pressure roller, thus exerting tension on the web. The web is between one and two mm in thickness and moves at a constant speed of 5 cm per 200 to 1,000 copies.

U.S. Pat. No. 4,557,588 discloses an image forming apparatus such as an electrophotographic copier, microfilm equipment, recording equipment, facsimile or printer. A movable cleaning member is maintained in contact with a member to clean its surface and the movement of the cleaning member is variably controlled according to the state of the image formation.

U.S. Pat. No. 4,939,552 discloses a cleaning device for cleaning the surface of an element of a copying apparatus to be cleaned by contacting a cleaning web therewith is connected to a driving mechanism of a scanning member of the coping apparatus and is driven in correlative movement with the scanning member. It is driven only when the scanning member returns to its original position by a one way clutch and by a constant amount of movement irrespective of the amount of movement of the scanning member.

U.S. Pat. No. 5,045,890 discloses a fuser apparatus for applying offset preventing liquid to a fuser roll including: a supply core; a rotatable take-up core; an oil impregnated web member adapted to be moved from the supply core to the take up core; a motor mechanically coupled to the take up roll for driving the web member from the the supply core to the take up core; a pressure roll in engagement with the web member and positioned to provide a contact nip for the web member with the fuser roll opposite the pressure roll wherein the contact of the web member with the fuser roll transfers oil from the web member to the fuser roll, and control means to vary the duty cycle operation of the motor to drive the web member at a relatively constant linear speed at the contact nip, the control means including a timer to monitor the cumulative time of operation of the motor and means to progressively decrease the duty cycle of the motor in response to the cumulative time of operation wherein the progressively decreased duty cycle of operation compensates for the increasing radius of the web member on the take up roll to maintain said relatively constant linear speed at the contact nip.

U.S. Pat. No. 5,049,944 discloses apparatus for applying offset preventing liquid to a fuser roll including an oil impregnated web to be moved relative to a fuser roll. A timer is employed to monitor the cumulative time of operation of a motor used to drive the web relative to the fuser roll and to progressively decrease the cycle of the motor so that essentially a uniform amount of the web is moved at each cycle.

JPPN-58-184173 (A) discloses a fuser apparatus in which one of the rolls is crowned in the center and the other is flared toward one end. The flared roller is also mounted at an angle to the center line of the crowned roller.

JPPN-61-251881 (A) discloses a fixed roller having an inverted crow shape along its length, which engages a belt entrained about two crown shaped rollers to act a part of a fixing device.

Additionally, there are several automatic printing machines commercially available, such as the Xerox 5028 model copier, which employ webs for providing release agents to fuser rolls. Other examples of such commercial devices, presently or currently available, include the Canon model 3225, 3725, 3000 series, 4000 series and 5000 series products. These products also all have liquid release agent impregnated webs supported between a supply roll and a take-up roll and urged into contact with the fuser roll by an open celled foam pinch roll.

In accordance with one aspect of the invention there is provided apparatus for fusing toner images to substrates, The apparatus comprises an elongated heated fuser roll having a crowned surface an elongated pressure roll having a crowned surface, with the pressure roll being supported for pressure engagement with the fuser roll to form a nip therebetween adapted to receive substrates. The apparatus according to this aspect can further comprise means for applying substantially uniform pressure and velocity on substrates in the nip, wherein the applying means comprises loading means for deflecting the pressure roll into pressure engagement with the fuser roll to form the nip. Means for supporting the pressure roll rotatably in contact with the fuser roll may also be supplied. The crowned surface of the fuser roll and pressure roll is approximately equal to the sum of the deflection of the fuser roll and the pressure roll. The pressure roll of this aspect of the invention can be provided with a surface having a maximum diameter in the central region thereof, and the fuser roll can be provided with a surface having a maximum diameter offset from the maximum diameter of the pressure roll. The fuser roll's surface can be provided with a maximum diameter positioned approximately one third of the length from one end thereof.

According to another aspect of the invention, there is provided a method for fusing toner images to substrates which comprises the steps of providing an elongated heated fuser roll having a crowned surface, and supporting an elongated pressure roll having a crowned surface in pressure engagement with said heated fuser roll to form a nip therebetween adapted to receive substrates. The method of this aspect can further comprise applying substantially uniform pressure in the nip and effecting substantially uniform velocity on substrates in the nip. The applying step can include deflecting the pressure roll and fuser roll in the nip. This aspect of the invention can further include fabricating the crowned surface of the pressure roll and the crowned surface of the fuser roll to correspond to the deflection of the fuser roll and the pressure roll induced by the applying step, and the method can comprise the step of transporting the substrate through the nip. Additionally, the method of this aspect may include the steps of heating the fuser roll so as to fix toner on the transported substrates thereto and offsetting the maximum diameter of the fuser roll from the maximum diameter of the pressure roll so as to apply a substantially uniform pressure.

Other aspects of the present invention will become apparent as the following description proceeds and upon reference to the drawings, in which.

Figure 1:
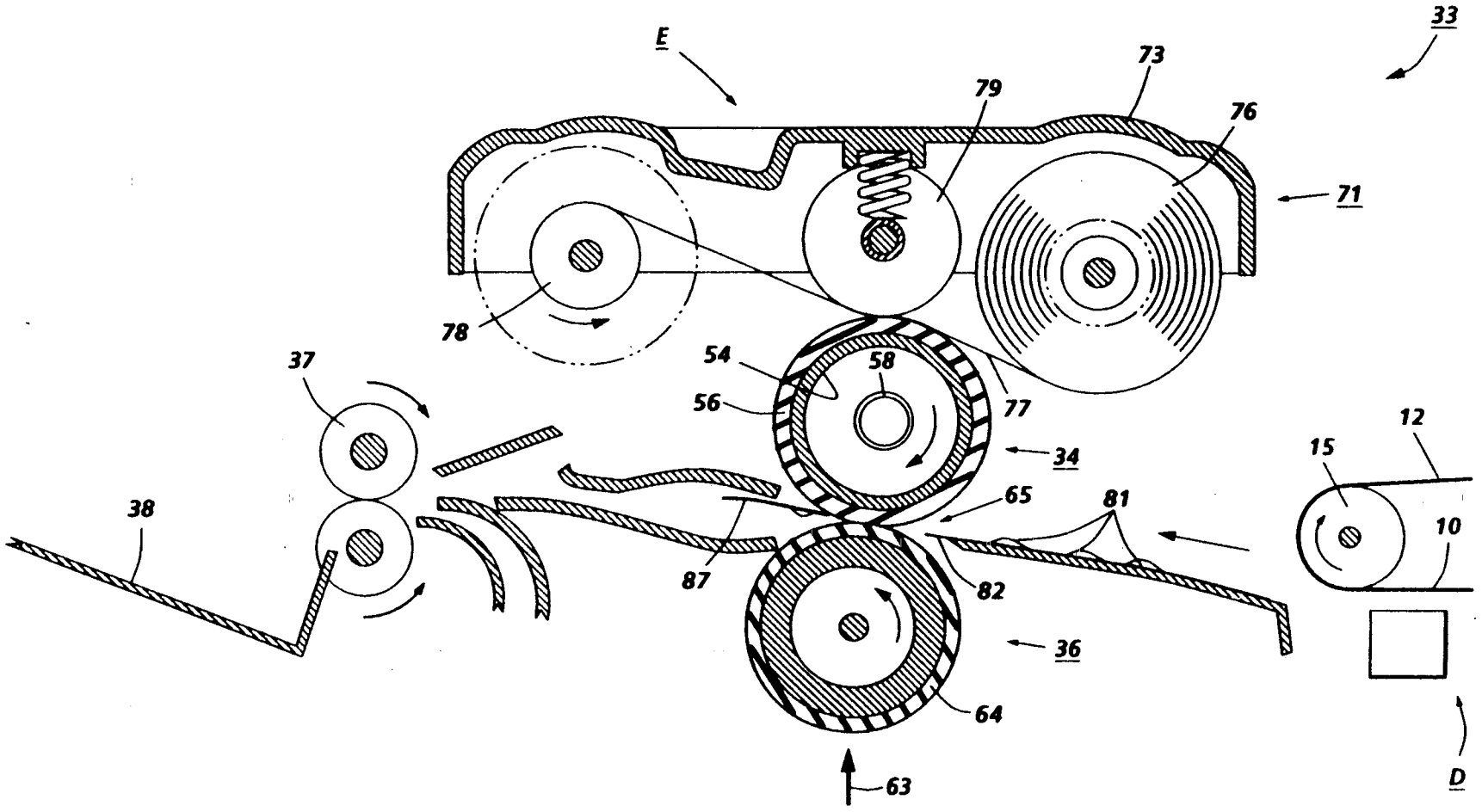
FIG. 1 is a enlarged elevational view of a fuser assembly incorporating the features of the present invention therein.

While the present invention will be described in connection with the preferred embodiment thereof, it will be understood that it is not intended to limit the invention to that embodiment. On the contrary, it is intended to cover all embodiments, modifications, and equivalents as may be included within the spirit and scope of the invention as defined by the appended claims. For a general understanding of the features of the present invention, references should be made to the drawings. In the drawings, like numerals have been used to identify identical elements.

Figure 3:
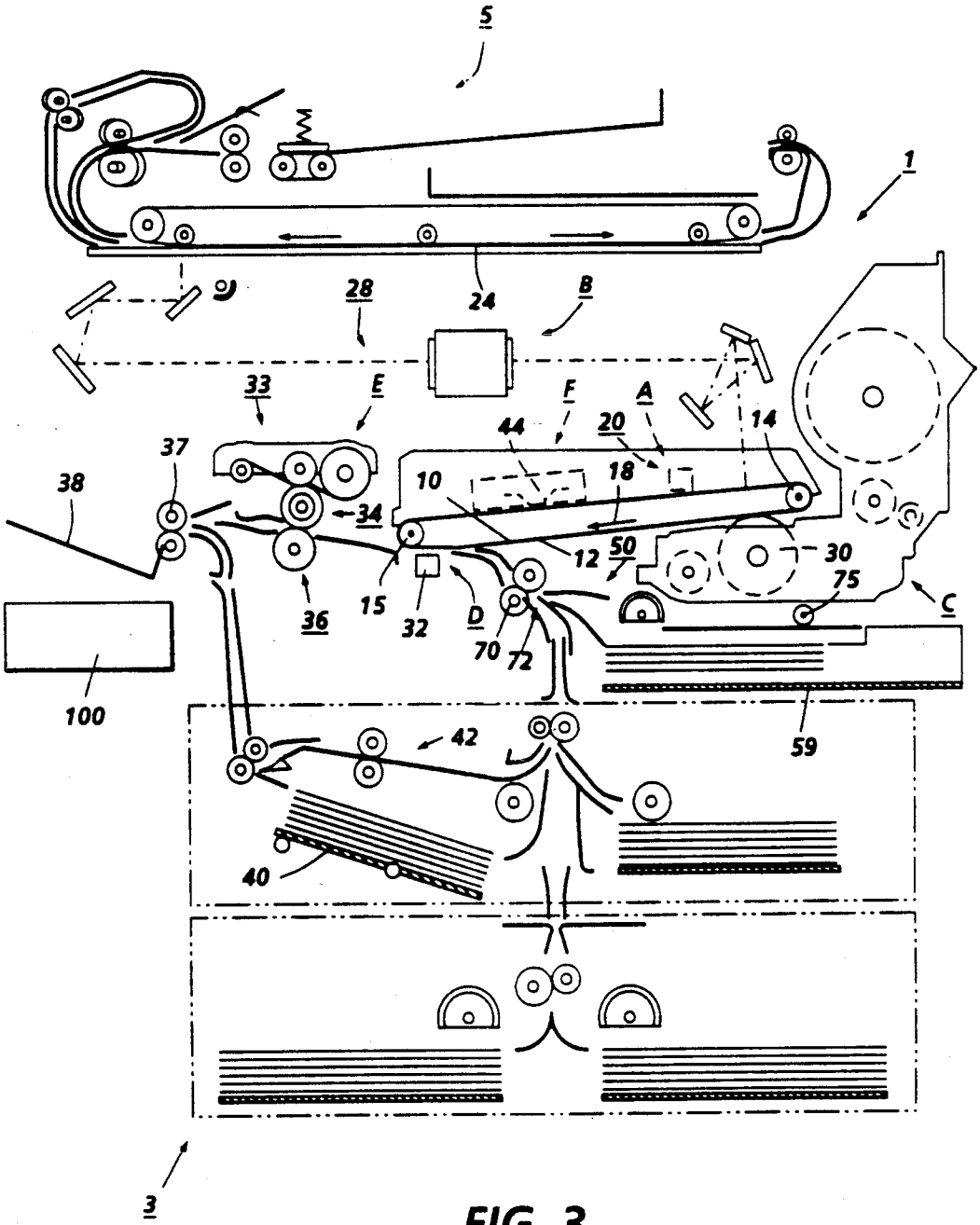
FIG. 3 is a schematic elevational view depicting an illustrative electrophotographic printing machine incorporating the fuser assembly of the present invention.

FIG. 3 schematically depicts a n illustrative electrophotographic printing machine of the type in which the present invention may be employed. Specifically, the printing machine 1 of FIG. 3 has both a copy sheet handling system 3 and a document handling system 5 for transporting sheets of material such as paper, Mylar and the like, to and from processing stations of the machine 1. The machine 1, has conventional imaging processing stations associated therewith, including a charging station A, an imaging/exposing station B, a development station C, a transfer station D, a fusing station E, and a cleaning station F. It will be understood that a conventional finishing station (not shown) could easily be included in the machine. The machine 1 has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 1 can be briefly described as follows:

The photoconductive belt 10 is charged at the charging station A by a corona generating device 20. The charged portion of the belt is then transported by action of the drive roller 14 to the imaging/exposing station B where a latent image is formed on the belt 10 corresponding to the image on a document positioned on a platen 24 via the light lens imaging system 28 of the imaging/exposing station B. It will also be understood that the light lens Imaging system can easily be changed to an input/output scanning terminal or an output scanning terminal driven by a data input signal to likewise image the belt 10.

The portion of the belt 10 bearing the latent image is then transported to the development station C where the latent image is developed by electrically charged toner material from a magnetic developer roller 30 of the developer station C. The developed image on the belt is then transported to a transfer station D where the toner image is transferred to a copy sheet substrate transported in the copy sheet handling system 3. In this case, a corona generating device 32 is provided to attract the toner image from the photoconductive belt 10 to the copy sheet substrate. The copy sheet substrate is transported to along either path 50 or 72 to the registration rolls 70 for passage through the transfer station D.

The copy sheet substrate with image thereon is then directed to the fuser station E. The fuser at station E includes a fuser apparatus 33, a heated fuser roll 34 and backup pressure roll 36. The heated fuser roll and pressure roll cooperate to fix the image to the substrate. The copy sheet then, as is well known, may be selectively transported via the reversible roll set 37 to an output tray 38 or along a selectable duplex path (i.e., tray 40 and path 42 in the case of the illustrative printing machine) for duplexing. The portion of the belt 10 which bore the developed image is then advanced to the cleaning station F where residual toner and charge on the belt is removed by a blade edge 44 and a discharge lamp (not shown). The cycle is then repeated.

The invention will now be discussed in greater detail with respect to FIG. 1, a heat and pressure fuser apparatus 33 including a web release agent delivery system, therefore, is schematically illustrated. As shown in FIG. 1, the fuser apparatus 33 comprises a heated fuser roll 34 which is composed of a core 54 having coated thereon of a thin layer 56 of an elastomer. The core 54 may be made of various metals such as iron, aluminum, nickel, stainless steel, etc., and various synthetic resins. Aluminum is preferred as the material for the core 54, although this is not critical. The core 54 is hollow and a heating element 58 is generally positioned inside the hollow core to supply the heat for the fusing operation. Heating elements suitable for this purpose are known in the art and may comprise a quartz heater made of a quartz envelope having a tungsten resistance heating element disposed internally thereof. The method of providing the necessary heat is not critical to the present invention, and the fuser member can be heated by internal means, external means or a combination of both. Heating means are well known in the art for providing sufficient heat to fuse the toner to the support. The thin fusing elastomer layer may be made of any of the well known materials, for example, RTV and HTV silicone elastomers.

The fuser roll 34 is shown in a pressure contact arrangement with a pressure roll 36. The pressure roll 36 comprises a metal core 62 with a layer 64 of a heat-resistant material. In this assembly, both the fuser roll 34 and the pressure roll 36 are mounted on bearings (not shown). The pressure roll bearings are mechanically loaded, as schematically indicated by the arrow 63 so that the fuser roll 34 and pressure roll 36 are pressed against each other under sufficient pressure to form a nip 65. It is in this nip that the fusing or fixing action takes place with toner images contacting the heated fuser roll 34. The layer 64 may be made of any of the well known materials such as fluorinated ethylene propylene copolymer or silicone rubber.

The liquid release agent delivery or management system 71 of the present invention comprises a housing 73 containing release agent material 74, for example, silicone oil. The silicone oil is applied to the surface of the fuser roll 34 via a web of material 77 which is impregnated with the oil which is drawn from supply 76 to a take up roll 78. The web material 77 is impregnated with silicone oil and upon contact with the fuser roll 34, it delivers silicone oil thereto. The web material 77 contacts the fuser roll at a nip formed between the fuser roll 34 and a pinch roll 79 formed of an open cell material for applying a thin coating of silicone thereon for preventing offset of images carried by a paper substrate. The liquid release agent may be selected from those materials which have been conventionally used. Typical release agents include a variety of conventionally used silicone oils including both functional and non-functional oils. Thus, the release agent is selected to be compatible with the rest of the system. It is preferred that the release agent delivery system 71 be of the type disclosed and discussed in U.S. patent application Ser. No. 08/000151 filed on the same date as the present application, entitled IMPROVED WEB RELEASE AGENT SYSTEM FOR A HEAT AND PRESSURE FUSER with the same named inventors as herein, assigned to Xerox Corporation, and which has been incorporated by reference herein.

Various other systems have been used to deliver release agent fluid to the fuser roll including the use of oil soaked rolls and wicks with and without supply sumps as well as oil impregnated webs. Another type of RAM system is disclosed in U.S. Pat. No. 4,214,549 issued to Rabin Moser on Jul. 29, 1980. As disclosed therein, release agent material is contained in a sump from which it is dispensed using a metering roll and a donor roll, the former of which contacts the release agent material and the latter of which contacts the surface of the heated fuser roll.

Figure 2:
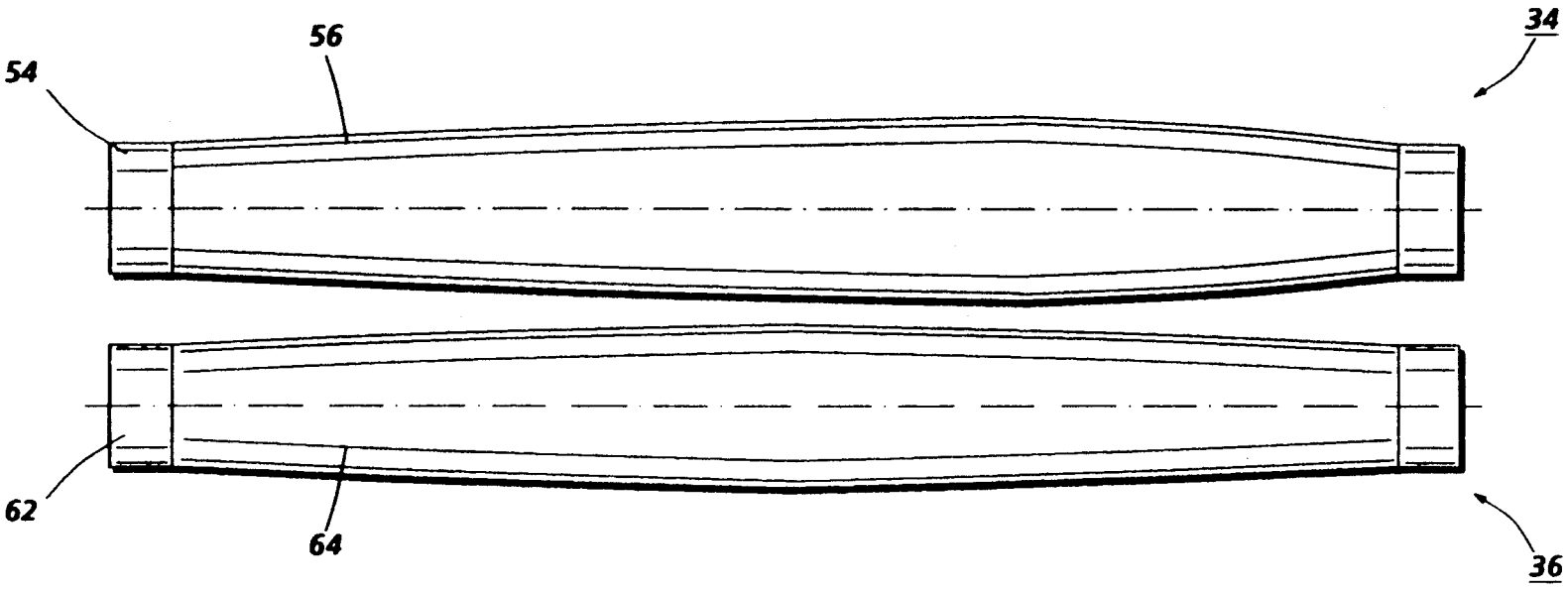
FIG. 2 is an enlarged elevational view of the fuser roll and the pressure roll of FIG. 1 shown in a non-engaged manner to illustrate the structure of the rolls.

The pressure roll 36 is crowned as is the fuser roll 34, as best seen in the enlarged elevational view of FIG. 2. The pressure roll 36 is supported in pressure engagement with the fuser roll 34 as indicated by arrow 63 in FIG. 1. The pressure roll 36 is crowned or larger in the center region of the roll than the ends to compensate for the bending of the fuser and pressure rolls, whereas the fuser roll 34 is crowned at an offset region to again account for the bending. The amount of radial increase (crown) is the sum of the defection of the fuser roll and pressure roll combination. The fuser roll stiffness is relatively unimportant so it can be made relatively thin and light so it warms up fast and is relatively inexpensive in power usage and construction. In a two roll fuser, warm-up time is an outgrowth of the roll mass required for adequate stiffness.

In this embodiment, a sheet 82 (FIG. 1) with toner 81 thereon is advanced to and through the nip 65 to affix images carried by the sheet to the sheet. In this case, the image has been transferred to the sheet 82 at a transfer station D. The transfer station D includes a corona generating device 32 proximate a moving photoconductive surface 12 between which the sheet has been directed to transfer the toner thereto, as is common in electrophotographic printers. The sheet, after passing through the nip 65, is directed toward an output tray 38 via reversing roll set 37 and associated guides or baffled surfaces. Stripper means 87, such as are well known in the art may be used to ensure separation of the sheet 82 from the fuser roll surface 56 after passing out of the nip.

Finally, as will be also understood, the control signals for the sheet handler operation are provided by controller 100, which is preferably a conventional microprocessor system, as is well known. It is contemplated that the controller controls all machine steps and functions described herein, as well as that of any and/or all apparatus and devices associated with the sheet handler, such as, for example, an electrophotographic printing machine.

By way of example, the fuser and pressure roll lengths are in the order of 10 to 36 inches. In an embodiment reduced to practice, the fuser and pressure outer surfaces were 12 inches long (320 mm). Also, by way of example the fuser roll wall thickness is approximately 0.2 inches (5.5 mm) and has a diameter of approximately 1.3 inches (32.2 mm) thereby providing a fairly low mass fuser roll capable of rapid warmup. The light weight fuser roll is about 10–20% as stiff as the steel pressure roll which has approximately 1.14 inches (28.5 mm) diameter and a wall thickness of approximately 0.5 inches (12.7 mm).

The increase in diameter of the fuser roll from and to maximum diameter, for the roll of the embodiment reduced to practice should increase from end to maximum width in a range between approximately 0.004 and 0.060 inches (0.01 and 0.15 mm), and preferably, approximately 0.020 inches (0.05 mm) (i.e., in the preferred embodiment reduce to practice the surface of the fuser roll varies in diameter from approximately 1.3 inches to 1.32 inches (32.2 to 32.25 mm). The diameter of the pressure roll increases from the ends to a maximum diameter in a range from between approximately 0.020 to 0.400 inches (0.05 to 1.0 mm) from end to maximum diameter with approximately 0.144 inches (0.36 mm) preferred (i.e., in the preferred embodiment reduce to practice the surface of the pressure roll varies in diameter from approximately 1.14 to 1.297 inches (28.5 mm to 28.86 mm)). This arrangement yields a substantially uniform sheet velocity profile for sheets passing through the nip. The velocity profile for such sheets is such that it increases only approximately 0.5% from the center of the rolls to edges of the rolls. Further, the arrangement also provides a relatively uniform nip pressure. It will be appreciated by those skilled in the art that the increase in velocity at the edges of sheets to be fused is actually a desirable condition. That is, it is enough of an increase to prevent creasing and yet not so much as to induce buckling of sheets, generally.

In this embodiment, the offset of the increase in diameter of the fuser roll to the increase in diameter of the pressure roll compensates for the fact that sheets are intended to pass along a registration edge when entering the nip. It will be understood by those skilled in the art that in a fuser assembly where the sheets are centrally fed relative to the rolls the maximum diameter of both rolls would be in the central region.

In this embodiment, with a fuser roll and pressure roll, each approximately 12 inches (320 mm) long with a registration edge positioned approximately 0.5 inches (12.7 mm) from one edge, it is preferred that the pressure roll be crowned at its center (e.g., approximately 5.8 inches (149 mm) from the registration edge along which sheets are fed to the fuser apparatus) and that the fuser roll is crowned at a distance approximately between approximately 6.75 and 9 inches (180 and 240 mm) with the preferred distance being approximately 6.3 inches (160 mm) from the registration edge. With the previously referenced sizes, the nip which is formed varies in size from approximately 0.175 inches (4.44 mm) proximate the registration edge to about 0.1650 inches (4.19 mm) at the center to about 0.1800 inches (4.57 mm) proximate the far edge (in this embodiment approximately 279.5 mm, 11 in.). The normal force or sheets in the nip varies from about 21.5 lbs./in. (3.76 n/mm) proximate the registration edge to about 17.25 lbs./in. (3.02 n/mm) at the center to about 0.23 lbs./in. (4.03 n/mm) proximate the far edge.

In one embodiment of the present invention it has been found desirable to employ a fuser roll having a maximum diameter positioned approximately one third of the length thereof. The fuser roll engages a pressure roller having a maximum diameter at the center thereof.

This permits fusing sheets of various sizes without skewing or wrinkling the sheets. In this arrangement, relatively narrow sheet (e.g., A-5 short-edge feed) and large sheet (e.g., A-4 short edge feed) are fed along the registration edge.

In recapitulation, the present invention the fuser roll and pressure roll are crowned in a barrel or convex shape. One of the rolls, either a pressure roll or a heated fuser roll (preferably the pressure roll), is crowned or larger in the central region than the ends and the other is crowned along its length but is larger at a region disposed away from the central region. By adjusting the shapes accordingly, compensation for the bending of the rolls is provided. The amount of radial increase for each roll (crown) is a function of the defection of the particular roll so that the fuser roll/pressure roll combination provides relatively equal pressure across the length of the fuser/pressure roll up. In this manner, the stiffness of the pressure roll and fuser roll Is relatively unimportant so each can be made thin and light allowing for greater cost and performance flexibility. This is particularly true in a two roll fuser as warm-up time is an outgrowth of the roll mass required for adequate stiffness, and cost is generally an outgrowth of roll mass. Further, the load (i.e., the normal force) on sheets in the nip is substantially uniform along the length of the rolls in the nips. The tangential velocity of the rolls, across their length, is different since the rolls vary in diameter along their lengths. This results in the surface speed varying due to the different radial dimensions of the rolls. The fuser roll and pressure roll nip, however, provides a relatively constant speed profile for sheets because the deflection strain is uniform and the effective circumference formed by the rolls in the nip region is substantially uniform. The speed profile of a sheet in the nip, thus, is substantially constant across the sheet. A slight sheet speed profile increase from center to the edges of approximately 0.5% is contemplated and beneficial. The total size and weight of a fuser is usually an important consideration in design, and the lesser weight and smaller size with increased performance provided hereby are useful.

While there has been illustrated and described what is at present considered to be a preferred embodiment of the present invention, it will be appreciated that certain changes and modifications are likely to occur to those skilled in the art, and it is intended in the appended claims to cover all those changes and modifications which fall within the true spirit and scope of the present invention.

What is claimed is:

1. Apparatus for fusing toner images to substrates, comprising:

an elongated heated fuser roll having a crowned surface and a non-crowned surface;

an elongated pressure roll having a crowned surface and a non-crowned surface, said pressure roll being supported for pressure engagement with said fuser roll to form a nip therebetween adapted to receive the substrates, said pressure roll comprises a surface having a maximum diameter in the central region thereof, and said fuser roll comprises a surface having a maximum diameter offset from the maximum diameter of said pressure roll;

means for applying substantially uniform pressure and velocity on the substrates in the nip, said applying means comprises loading means for deflecting said pressure roll into pressure engagement with said fuser roll to form the nip, wherein the sum of the distance between the non-crowned surface and crowned surface of said fuser roll and said pressure roll is approximately equal to the sum of the deflection of said fuser roll and said pressure roll so that said fuser roll and said pressure roll form substantially non-crowned surfaces when in pressure engagement with one another and;

means for supporting said pressure roll rotatably in contact with said fuser roll.

2. Apparatus for fusing toner images to substrates, comprising:

an elongated heated fuser roll having a crowned surface and a non-crowned surface, said fuser roll comprises a surface having a maximum diameter positioned approximately one third of the length from one end thereof;

an elongated pressure roll having a crowned surface and a non-crowned surface, said pressure roll being supported for pressure engagement with said fuser roll to form a nip therebetween adapted to receive the substrates, said pressure roll comprises a surface having a maximum diameter in the central region thereof, and;

means for applying substantially uniform pressure and velocity on the substrates in the nip, said applying means comprises loading means for deflecting said pressure roll into pressure engagement with said fuser roll to form the nip, wherein the sum of the distance between the non-crowned surface and crowned surface of said fuser roll and said pressure roll is approximately equal to the sum of the deflection of said fuser roll and said pressure roll so that said fuser roll and said pressure roll form substantially non-crowned surfaces when in pressure engagement with one another and;

means for supporting said pressure roll rotatably in contact with said fuser roll.

3. A method for fusing toner images to substrates, comprising the steps of:

providing an elongated heated fuser roll having a crowned surface and a non-crowned surface;

supporting an elongated pressure roll having a crowned surface and a non-crowned surface in pressure engagement with the heated fuser roll to form a nip therebetween adapted to receive the substrates;

applying uniform pressure in the nip and effecting velocity on the substrates in the nip, said applying step includes deflecting the pressure roll and the fuser roll in the nip;

fabricating the crowned surface of the pressure roll and the crowned surface of the fuser roll so that the sum of the distance between the non-crowned surface and crowned surface corresponds to the deflection of the fuser roll and the pressure roll induced by said deflection step causing the fuser roll and pressure roll to form a substantially non-crowned surface when in pressure engagement with one another;

transporting the substrate through the nip;

heating the fuser roll so as to fix toner on the transported substrates thereto; and offsetting a maximum diameter of the fuser roll from a maximum diameter of the pressure roll so as to apply a substantially uniform pressure.

* * * * *